United States Patent [19]

Cormier, Jr.

[11] 4,378,818

[45] Apr. 5, 1983

[54] WELL DRILLING FLOAT VALVE

[76] Inventor: Arthur J. Cormier, Jr., 122 Downing, Lafayette, La. 70506

[21] Appl. No.: 217,566

[22] Filed: Dec. 17, 1980

[51] Int. Cl.[3] ..... F16K 21/04

[52] U.S. Cl. ..... 137/523; 137/463; 251/82; 166/325

[58] Field of Search ..... 137/513.5, 515, 522, 137/523, 527, 463; 251/82, 287; 166/323, 325

[56] References Cited

U.S. PATENT DOCUMENTS

| | | | |
|---|---|---|---|
| 2,162,578 | 6/1939 | Hacker | 251/89 |
| 2,587,358 | 2/1952 | McRae | 137/463 |
| 2,694,408 | 11/1954 | McRae | 137/463 |
| 3,058,534 | 10/1962 | Keithahn | 137/515.7 |
| 4,117,860 | 10/1978 | Carlin | 137/513.5 |

*Primary Examiner*—Alan Cohan
*Assistant Examiner*—John A. Rivell
*Attorney, Agent, or Firm*—Charles C. Garvey

[57] ABSTRACT

A float valve for use with drill pipe or drill casing or the like in a well is provided wherein a valving flapper can be set in a partially open position while lowering the drill pipe or drill casing into a well thereby allowing the drill pipe or casing to fill with drilling mud or fluid thus preventing inadvertent collapse of the drill pipe or the drill casing. Once the drill string and the valve are fully in the hole, the valving flapper moves, responsive to circulation through the valve bore, from the partially open position to a fully open position allowing the valve flapper to freely pivot thereafter within the provided valve body between fully open and fully closed positions. The valve flapper is thus free to close in a back pressure situation or due to a blowout or for any such other reason. During circulation of drilling fluids or the like, the flapper is maintained in an open flow condition.

11 Claims, 6 Drawing Figures

WELL DRILLING FLOAT VALVE

BACKGROUND OF THE INVENTION

1. Field of the Invention

The present invention relates to well drilling and well drilling devices. More particularly, the present invention relates to a drill pipe float valve wherein the valve can be lowered into the hole in a preset partially open position and thereafter disengaged from the partially open preset position, and after such disengagement being freely movable allowing the valve to be opened (responsive to fluid circulation into the well) or closed (responsive to fluid back pressure acting upon the drill string bore).

2. General Background

It is known that during the lowering of drill pipe into a well having drilling fluid therein, it has been necessary to frequently stop and fill the pipe with fluid using a conventional float valve.

Examples of such earlier float valves are shown in U.S. Pat. Nos. 3,058,534 and 2,162,578. Such stopping and filling is undesirable from the standpoint of loss of valuable and expensive rig time.

Some float valves have been patented which have attempted to solve the problem of keeping the float valve partially open during filling. U.S. Pat. No. 3,446,237 to W. L. Haley issued May 27, 1969, provides a drill pipe float valve directed to the problem of maintaining the valve at an open position while lowering drill pipe into the well.

Other valve constructions are seen in U.S. Pat. Nos. 3,687,157 and 3,525,394.

U.S. Pat. Nos. 3,997,009, 2,481,397, 3,013,612 and 2,162,578 all show a valve having a sliding inner pipe that holds the valve open.

In U.S. Pat. Nos. 2,694,408 and 2,587,358 there is seen pressure actuated valves.

General Discussion of the Present Invention

The present invention provides a float valve for use with drill pipe wherein there is provided a valve body with a longitudinal flow bore being provided therethrough. A flapper valve member is pivotally mounted on the valve body and swings between open and closed positions. A catch arm is pivotally mounted on the valve flapper movable between engaged and disengaged positions. In the engaged position, the catch arm holds the flapper valve in a partially open position which allows fluid flow to pass through the valve body longitudinal bore as in the case of filling of the drill pipe or casing as the string is run into the hole.

Responsive to pump pressure within the drill string, the valve flapper is forced to a fully open position during such circulation with the valve flapper disengaging the catch member attached thereto from its engagement with the valve body where it holds the valve flapper in a partially open position.

A biasing spring is provided on the valve flapper which spring urges the catch to assume a normally disengaged inoperative position in which position the catch is withdrawn to the underside of the flapper allowing the valve flapper to freely operate from fully open to fully closed positions without being stopped by the catch in the intermediate partially open position.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
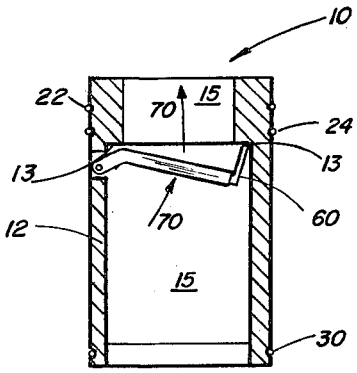
FIG. 1 is a sectional view of the preferred embodiment of the apparatus of the present invention with the valve flapper in the partially open position useful while lowering the drill string into the well.
Figure 4:
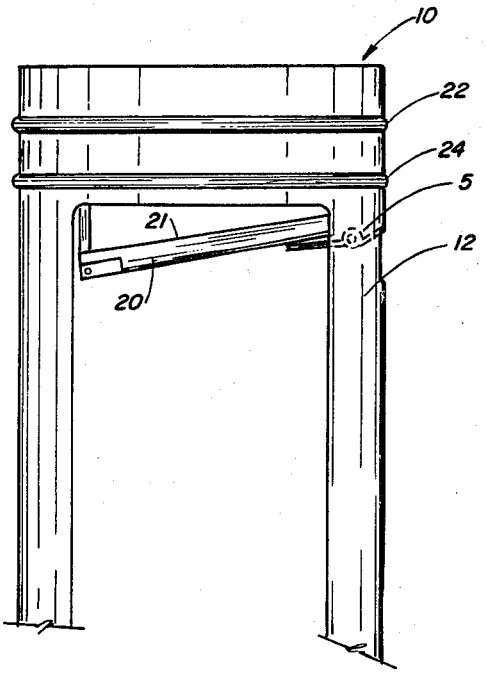
FIG. 4 is a partial view of the preferred embodiment of the apparatus of the present invention illustrating the flapper valve in its partially open position.

FIGS. 1–5 illustrate the preferred embodiment of the apparatus of the present invention designated generally by the numeral 10. Float valve 10 can be mounted near the lower end portion of a string of drill pipe in a conventional manner as is known in the use of float valves. Normally an adapter sub 11 is provided with the float valve 10 being mounted therewithin.

Float valve 10 provides a body 12 which is generally cylindrical and which has a longitudinal bore 15 extending therethrough in proximity to a valve flapper 20.

The upper portion of body 12 provides, for example, a pair of seal rings 22, 24 which occupy annular grooves 26, 28. The sealing portion of valve 10 also includes a lower seal ring 30 of, for example, rubber or other resilient material which seal 30 also occupies an annular provided groove 32. Seal rings 22, 24, 30 insure a sealed fit of valve 10 within sub 11.

Float valve 10 provides a valve flapper 20 which is preferably in a generally circular configuration with a upper surface 21 which can be at its peripheral edge substantially flat, forming an upper sealing surface which seals against the annular seat 13 of valve body 12.

A pair of brackets 40, 42 integrally formed to flapper 20 form a swing arm which allow the attachment in a pivotal fashion of flapper valve 20 to valve body 12 by using a pinned connection, for example.

Openings 44, 46 having a common axis 45 allow attachment of flapper valve 20 at brackets 40, 42 to valve body 12 by means of a suitable pin 50 or the like.

Figure 3:
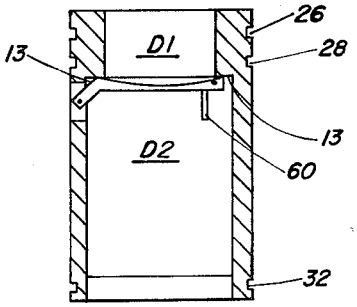
FIG. 3 is a sectional view of the preferred embodiment of the apparatus of the present invention illustrating the valve flapper in a fully closed position as occurs during backflow or blowout conditions.

Attached pivotally at the opposite end portion of valve flapper 20 from brackets 40, 42 is catch 60 which is pivotally attached at pivot pin 62 to valve flapper 20. FIGS. 3 and 5A show catch 60 in its normal position which is retracted and allows flapper 20 to seat against seat 13 and to seal off bore 15 as is desirable in backflow conditions. This closed position of flapper 20 is seen in FIG. 3.

A biasing is provided in the form of spring S which urges valve flapper 20 into the closed position of FIGS. 3 and 5A. This biasing can be overcome by manipulation of a human operator who merely grabs catch 60 and rotates it in the direction shown by arrows 65 in FIG. 5A. Once rotated approximately 180 degrees to the position shown in FIGS. 1 and 4, flapper 20 is prevented from closing fully to the closed position of FIG. 3 but rather assumes a partially open position with catch 60 abutting the intersection of seat 13 and wall 12. Note from FIGS. 1–3 that bore 15 expands at seat 13 from a smaller diameter D1 to a larger diameter D2 thus producing the annular seat and a position for the anchoring of catch 60 as is desirable to hold flapper 20 in a partially open position. This partially open position is used when going into the hole and allows the drill string to fill as flow would proceed as shown by arrows 70 in FIG. 1 into bore 15 past valve flapper 20.

Figure 2:
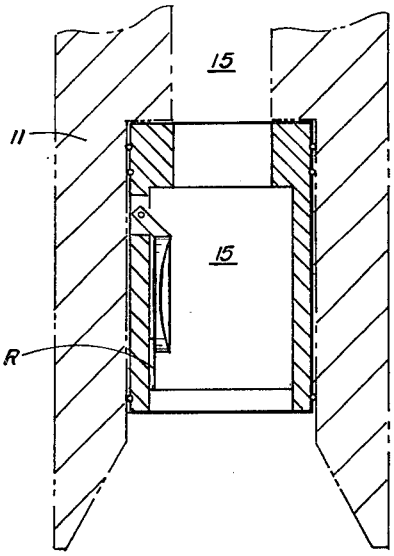
FIG. 2 is a sectional view of the preferred embodiment of the apparatus of the present invention as shown placed within an adaptive sub.

Once in the hole, the operator of the drilling rig would then turn on his pumps to circulate fluid through the drill string and through sub 11 and thereafter through bore 15 pushing flapper 20 to an open position as shown in FIG. 2. Once this occurs, the catch 60 will no longer be held in its uppermost operative position as shown in FIG. 1 but rather will be moved to the retracted position R. One skilled in the art will appreciate that once this initial sequence has been followed, catch 60 will thereafter be in the disengaged retracted position beneath flapper 20 and pose no problem to the subsequent opening and closing of flapper 20 to the positions shown in FIG. 2 or FIG. 3.

The catch arm 60 assumes an inoperative position when the flapper 20 opens as in FIG. 2. For example, after the drilling rig operator turns on fluid pumps to circulate fluid through the bore 15, and depending upon the fluid being pumped, the fluid flow rate, and flow pressure, as well as turbulent or laminar flow, etc., the catch arm 60 might, for example, assume the position of FIG. 2, or project radially into bore 60, or assume a position between such a radial position and the position of FIG. 2. It should be understood, that when the valve flapper 20 is open as shown in FIG. 2, arm 60 in fact serves no function, and is in an inoperative position.

Figure 5:
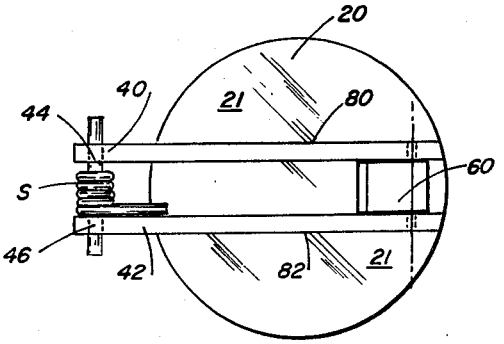
FIGS. 5 and 5A are top and sectional views respectively of the valve flapper and catch portions of the preferred embodiment of the apparatus of the present invention.
Figure 5A:
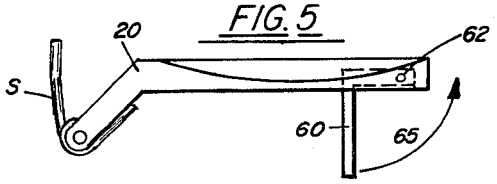

As best seen in FIGS. 5 and 5A, brackets 40 and 42 could extend across the entire diameter of flapper 20 providing a reinforcement thereto. Extensions of brackets 40, 42 are seen in the form of support ribs 80, 82 on the surface 21 of flapper 20.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A float valve comprising:

a. a valve body having a flow bore therethrough;

b. a valve seat on said valve body at said bore;

c. a flapper valve pivotally mounted on said valve body between fully open flow and fully closed flow positions, with said flapper valve sealing said seat in the fully closed position;

d. spring means cooperatively connected to the valve body and flapper valve for urging the flapper valve toward the fully closed position;

e. pre-settable catch means carried by and movably mounted upon the flapper valve between engaged and disengaged positions for preventing movement of the flapper valve to the fully closed position when the catch means desirably occupies the engaged position as so pre-set, the flapper valve thus assuming a partially open position responsive to both urging of the spring means and the pre-set engaged positioning of the catch means; and f. biasing means associated with the catch means for biasing the catch means to the disengaged position when the flapper valve moves from the partially open position to the fully open position, the flapper valve being movable to the fully closed position when the catch means is disengaged.

2. The float valve of claim 1, wherein said valve seat is an annular rib formed substantially perpendicular to the central axis of said bore.

3. The float valve of claim 1, wherein said spring means is a spring mounted on said body at the pivotal mount of said flapper thereto.

4. The float valve of claim 1, wherein said catch means is a catch arm pivotally mounted on said flapper valve and movable between engaged and disengaged positions.

5. The float valve of claim 1, wherein said catch means is mounted on said flapper valve substantially opposite the pivotal attachment of said flapper valve to said valve body.

6. The float valve of claim 1, further comprising a pivot pin carrying a spring, the pin provided at the pivotal connection of said flapper valve to said valve body, the spring urging said flapper valve into the fully closed position in which said flapper valve seals said valve seat.

7. The float valve of claim 1, wherein said catch means is movably mounted on said flapper valve between disengaged and engaged positions, with said catch means providing at least in part at said engaged position an arm spanning between said valve seat and said flapper valve with said arm being connected at one end portion to said flapper valve and at its other end portion resting against said seat.

8. The float valve of claim 1, wherein said flapper valve is generally circular and said valve seat comprises at least in part an enlargement of said bore from a first uniform cylindrical bore above said seat to a larger uniform cylindrical bore below said seat with said enlargement providing an annular rib substantially perpendicular to the direction of flow.

9. The float valve of claim 4, wherein said catch arm is an elongated arm connected at one end portion pivotally to said valve flapper and being movable between an engaged position placing said arm generally above said valve seat and substantially perpendicular to said valve seat upper surface, said arm being substantially below said valve seat in said disengaged position and substantially perpendicular to the lower surface of said valve seat.

10. A float valve for use with drill pipe and the like comprising:

a. a valve body having a flow bore therethrough;

b. a valve seat formed on said valve body at said bore, said valve seat formed substantially perpendicular to the central axis of said bore;

c. a spring biased generally circular flapper valve pivotally mounted on said valve body between open flow and closed flow positions with said flapper valve sealing said valve seat in said closed position and being spring biased toward the closed position;

d. a catch arm pivotally mounted on said flapper valve and movable between a pre-set engaged and disengaged positions, the engaged position preventing a full closure of said flapper valve to said closed position, said catch arm being mounted on said flapper valve substantially opposite the pivotal attachment of said flapper valve to said valve body, and said catch arm spanning between said valve seat and said flapper valve when in the engaged position; and e. biasing means comprising in part the weight and shape of said arm for moving said catch arm to an inoperative disengaged position in which position said catch arm allows said flapper valve to move unrestricted by said catch arm between said open flow and said closed flow positions.

11. The float valve of claim 10, wherein said valve seat comprises at least in part an enlargement of said bore from a first uniform cylindrical bore above said seat to a larger uniform cylindrical bore below said seat with said enlargement providing an annular rib substantially perpendicular to the direction of flow.

* * * * *